US006369023B1

(12) United States Patent
Rodrigues et al.

(10) Patent No.: US 6,369,023 B1
(45) **Date of Patent: *Apr. 9, 2002**

(54) USE OF POLYETHER HYDROXYCARBOXYLATE COPOLYMERS IN TEXTILE MANUFACTURING AND TREATING PROCESSES

(75) Inventors: Klein A. Rodrigues, Signal Mountain; Allen M. Carrier, Hixson; Michael C. Hazlewood, Knoxville, all of TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/225,768

(22) Filed: Jan. 5, 1999

(51) Int. Cl.[7] ..... C11D 3/38

(52) U.S. Cl. ..... 510/476; 510/434; 510/477; 510/479; 8/115.6; 8/139; 8/495; 8/537

(58) Field of Search ..... 510/434, 476, 510/477, 479; 8/101, 107, 115.6, 125, 139, 495, 537, 636

(56) References Cited

U.S. PATENT DOCUMENTS

| | | | | | |
|---|---|---|---|---|---|
| 3,692,685 | A | | 9/1972 | Lamberti et al. | 252/89 |
| 3,769,223 | A | | 10/1973 | Pearson et al. | 252/89 |
| 3,776,850 | A | | 12/1973 | Pearson et al. | 252/89 |
| 4,228,300 | A | | 10/1980 | Lannert | 260/180 |
| 4,440,663 | A | * | 4/1984 | Boyer et al. | 510/102 |
| 4,654,159 | A | | 3/1987 | Bush et al. | 252/95 |
| 4,916,178 | A | | 4/1990 | Amata et al. | 524/401 |
| 5,980,580 | A | * | 11/1999 | Yamaguchi et al. | 8/137 |
| 6,180,589 | B1 | * | 1/2001 | Rodrigues | 510/479 |

FOREIGN PATENT DOCUMENTS

| | | | |
|---|---|---|---|
| EP | 0 414 228 | 2/1991 | C11D/3/37 |
| JP | 49-116024 | 11/1974 | |
| JP | 51-36248 | 10/1976 | C07C/59/23 |

* cited by examiner

*Primary Examiner*—Cynthia H. Kelly
*Assistant Examiner*—Dawn L. Garrett
(74) *Attorney, Agent, or Firm*—Thomas F. Roland

(57) ABSTRACT

The use of polyether hydroxycarboxylate copolymers in textile manufacturing and treating processes. The polyether hydroxycarboxylate copolymer has the structure

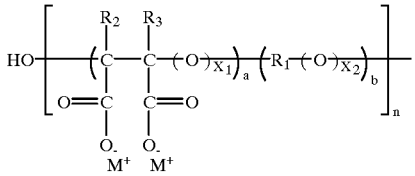

wherein $M^+$ is a cation wherein M is independently selected from the group consisting of hydrogen, ammonia, alkali metals, alkaline earth metals, zinc, copper, organic amines, amino acids, and amino saccharides; $R_1$ is the residue of an ethylenically unsaturated comonomer having at least one functional group which is selected from the group consisting of carboxylic acid, sulfonic acid and phosphonic acid; $R_2$ and $R_3$ are independently selected from the group consisting of hydrogen, and a substituted or unsubstituted alkyl group having 1 to 4 carbon atoms; n is from about 2 to about 100; $X_1$ and $X_2$ are independently 0 or 1; a is from 0 to 100 mole percent; and b is from 100 to 0 mole percent, provided that (a+b) is 100 mole percent. The copolymers chelate heavy metal ions forming soluble complexes which help stabilize bleach, reduce scale, prevent redeposition of particulate soils, prevent deposition of metals, and disperse dyes.

18 Claims, No Drawings

USE OF POLYETHER HYDROXYCARBOXYLATE COPOLYMERS IN TEXTILE MANUFACTURING AND TREATING PROCESSES

FIELD OF THE INVENTION

This invention relates to the use of polyether hydroxycarboxylate copolymers in textile manufacturing and treating processes. The copolymers help stabilize bleach and reduce scale, prevent redeposition of particulate soils, prevent deposition of metals, and disperse dyes.

BACKGROUND OF THE INVENTION

Heavy metal ions and salts deleteriously effect the desizing, scouring, bleaching, mercerising, and dyeing processes of textiles. For example, in the bleaching process, bleaching by hydrogen peroxide is generally carried out under an alkaline condition of a pH value of 10 to 14, and the reaction effectively improving the whiteness is represented by the formula: $H_2O_2 \rightarrow HO^-{}_2 + H^+$, the active bleaching component is the perhydroxyl ion. However, under alkaline conditions (pH of at least 10), the side reaction represented by the formula: $2H_2O_2 \rightarrow 2H_2O + O_2$ is promoted by heavy metal ions which are contained in cellulose fibers of cotton, flax or the like, and in a bleaching bath, such as iron, calcium, copper and manganese, and therefore, discoloration of the fibers occurs, and the fibers are made brittle.

To eliminate this disadvantage, sodium silicate is frequently used as a bleach stabilizer, but the use of sodium silicate is disadvantageous in that water-insoluble salts of calcium and magnesium, i.e., silicate scales, are formed, and these insoluble salts adhere to and are deposited on a bleached textile and a bleaching apparatus to cause a silicate scale problem.

Bleach stabilizers other than sodium silicate include polyphosphoric acid salts such as sodium tripolyphosphate, and aminocarboxylate organic chelating agents such as ethylenediamine-tetraacetic acid (EDTA) and diethylenetriamine-pentaacetic acid (DTPA). These bleach stabilizers do not cause a silicate scale problem, however, at a pH of 10 to 14, the chelating capacity is reduced. Moreover, these bleach stabilizers are insolubilized in the presence of an excessive amounts of hardness ions.

Heavy metal ions also cause problems in the desizing, scouring, mercerising, and dyeing processes of textiles by complexing with hydroxyl groups to form insoluble salts. The insoluble salts deposit on textiles and equipment causing scale problems and blemishes on textiles.

SUMMARY OF THE INVENTION

The invention comprises a processing aid for use in a textile manufacturing or treating process, said processing aid comprises a polyether hydroxycarboxylate copolymer having the structure

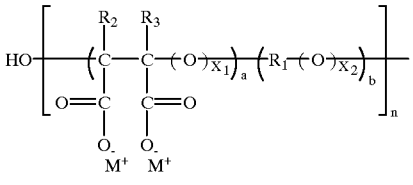

wherein $M^+$ is a cation wherein M is independently selected from the group consisting of hydrogen, ammonia, alkali metals, alkaline earth metals, zinc, copper, organic amines, amino acids, and amino saccharides; $R_1$ is the residue of an ethylenically unsaturated comonomer having at least one functional group which is selected from the group consisting of carboxylic acid, sulfonic acid and phosphonic acid; $R_2$ and $R_3$ are independently selected from the group consisting of hydrogen, and a substituted or unsubstituted alkyl group having 1 to 4 carbon atoms; n is from about 2 to about 100; $x_1$ and $x_2$ are independently 0 or 1; a is from 0 to 100 mole percent; and b is from 100 to 0 mole percent, provided that (a +b) is 100 mole percent, wherein said processing aid is present in an amount of from about 0.001 to about 50 weight percent, based on the weight of the solution or dispersion used in the textile process.

Another aspect of the invention is an improved bleaching process for preparing woven textiles comprising sizing fibers to be woven in the presence of from about 0.01 to about 10 weight percent of the polyether hydroxycarboxylate copolymer.

An additional aspect of the invention is an improved desizing process for textiles comprising desizing woven textile material in the presence of an alkaline substance and from about 0.001 to about 50 weight percent of the polyether hydroxycarboxylate copolymer.

A further aspect of the invention is an improved scouring process for textiles comprising scouring textiles in the presence of from about 0.001 to about 50 weight percent of the polyether hydroxycarboxylate copolymer.

The polyether hydroxycarboxylate copolymer functions as a processing aid and complexes heavy metal ions in the manufacturing or treating of textiles. For example, the polyether hydroxycarboxylate copolymers help stabilize hydrogen peroxide in the bleaching process, reduce scale and prevent deposition of heavy metal ions such as iron, calcium and magnesium during the scouring, desizing, mercerising, and bleaching processes. In addition, the polyether hydroxycarboxylate copolymers prevent redeposition of particulate soils onto the textiles.

Furthermore, in the dyeing process, the polyether hydroxycarboxylate copolymers disperse direct and dispersed dyes, and suspend unfixed dyes, and thus, provide a consistent and level dyeing of textiles. An additional advantage is that the polyether hydroxycarboxylate copolymers complex salts, such as calcium, magnesium and iron salts, during the dyeing process which prevents the salts from depositing on the textiles and causing blemishes, or precipitating the dyes out of solution which reduces the efficiency of the dyes.

DESCRIPTION OF THE INVENTION

This invention provides a processing aid for use in a textile manufacturing or treating process. Such textile manufacturing and treating processes include desizing, scouring, mercerising, bleaching, and dyeing processes. As used herein, these terms have the following meanings:

(1) "Desizing" process is essentially a part of the scouring process, and rapid removal of size is important especially in continuous preparation processes. Desizing of sized fabrics is commonly carried out using water washing at varying temperatures or with enzymes. Desizing can also be carried out effectively with alkaline, preferably caustic solutions, and those alkaline solutions can be very dilute.

(2) "Scouring" process involves removing or reducing the level of fats, waxes, oils, dirt, and so forth on a textile.

Apart from the aesthetic benefits of clean fabric, the major reason for scouring is to improve the extent and uniformity of absorbency for subsequent processes, especially dyeing. Scouring generally takes place using mild alkalinity and surfactants as wetting agents, such as alkylbenzenesulfonate and alkylphenol ethoxylates. It is noted that scouring is particularly important with natural fibers which contain much more extraneous matter than synthetic fibers. For example, cotton, requires high alkalinity scouring, which swells the fibers, allowing access to the lumen and removing soil from the surface.

(3) "Bleaching" process involves bleaching of the various types of textiles with a peroxide bleaching compound. Suitable peroxide compounds are water soluble peroxides, particularly alkali metal peroxides, preferably sodium peroxide, and hydrogen peroxide, the latter being particularly preferred. The peroxide bleaching is carried out in an alkaline medium. To achieve the alkaline conditions, it is advantageous to use an alkali metal hydroxide, preferably potassium or sodium hydroxide.

(4) "Mercerising" process is used to swell cotton fibers in order to increase their lustre, strength, and dyeability. Generally, a cold solution of sodium hydroxide is used, however, hot mercerising techniques and the use of acids, such as cresylic acid along with a cosolvent, may also be employed.

(5) "Dyeing" process involves the application of a solution or a dispersion of a dye to a textile followed by some type of fixation process. The dye solution or dispersion is almost always an aqueous medium, and a major objective of the fixation step is to ensure that the colored textile exhibits satisfactory fastness to subsequent treatment in aqueous wash liquors.

Suitable textiles to be treated with the polyether hydroxycarboxylate copolymers of the invention are, for example, cotton, polyacrylics, polyamides, polyesters, polyolefins, rayons, wool, linen, jute, ramie, hemp, sisal, regenerated cellulosic fibers such as rayon or cellulose acetate, and blends thereof. The textiles can be in a variety of forms, for example, yarn, tops, woven, knitted, plush and carpets.

The processing aid of the invention comprises a polyether hydroxycarboxylate copolymer having the structure

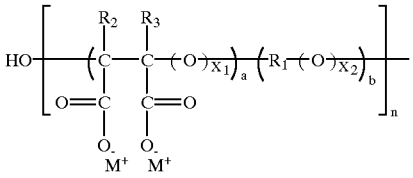

wherein $M_+$ is a cation wherein M is independently selected from the group consisting of hydrogen, ammonia, alkali metals, alkaline earth metals, zinc, copper, organic amines, amino acids, and amino saccharides. Preferably the cation is independently hydrogen or sodium.

In the above structure for the polyether hydroxycarboxylate copolymer, $R_2$ and $R_3$ are independently selected from the group consisting of hydrogen, an alkyl group having 1 to 4 carbon atoms, a substituted alkyl group having 1 to 4 carbon atoms, and combinations thereof. When $R_2$ and $R_3$ are hydrogen, the monomer used to prepare the repeating unit (a) is maleic acid. However, methylmaleic acid (citraconic acid) and other substituted cisbutenedioic acids can be substituted for maleic acid.

In the above structure for the polyether hydroxycarboxylate copolymer, $R_1$ is the residue of an ethylenically unsaturated comonomer having at least one functional group which is selected from the group consisting of carboxylic acid, sulfonic acid and phosphonic acid. Suitable ethylenically unsaturated comonomers having a carboxylic acid functional group are acrylic acid, methacrylic acid, itaconic acid, ethacrylic acid, alpha-chloro-acrylic acid, alpha cyano acrylic acid, crotonic acid, alpha phenyl acrylic acid, beta acryloxy propionic acid, sorbic acid, angelic acid, cinnamic acid, glutaconic acid, 2-acrylamido glycolic acid, and tricarboxyethylene. A preferred ethylenically unsaturated comonomer having carboxylic acid functional groups is itaconic acid.

Suitable ethylenically unsaturated comonomers having a sulfonic acid or phosphonic acid functional group are vinyl sulfonic acid, sodium methallyl sulfonate, 2-acrylamido 2 methyl propane sulfonic acid, allyloxybenzene sulfonic acid, and vinyl phosphonic acid. Preferred ethylenically unsaturated comonomers having a sulfonic acid or phosphonic acid functional group are vinyl sulfonic acid and vinyl phosphonic acid.

Thus, the polyether hydroxycarboxylate copolymer is prepared from (a) and (b) repeating units. The (a) repeat units are derived from either maleic acid, methylmaleic acid, or other substituted cisbutenedioic acids. The (b) repeat units are derived from an ethylenically unsaturated comonomer having at least one functional group which is selected from the group consisting of carboxylic acid, sulfonic acid and phosphonic acid.

In the above structure for the polyether hydroxycarboxylate copolymer, n is from about 2 to about 100. Preferably n is from about 2 to about 20, more preferably from 2 to 10. The letters $X_1$ and $X_2$ are independently 0 or 1. The letter a is from 0 to 100 mole percent, preferably to 100 mole percent. The letter b is from 0 to 100 mole percent, preferably 0 to 80 mole percent, provided that (a +b) is 100 mole percent.

A preferred process for preparing the polyether hydroxycarboxylate copolymers involves mixing the monomer(s) responsible for repeating unit (a) and comonomer(s) responsible for repeating unit (b) together with water to form a mixture. The monomer(s) and comonomer(s) in the mixture are neutralized or partially neutralized using a base. A preferred base is sodium hydroxide. Preferably, at least 60% of the total acid groups are neutralized.

The next step involves epoxidation of the ethylenically unsaturated double bonds present in the monomer(s) and comonomer(s) to form a mixture of epoxides. Methods for epoxidation are well known in the art, such as described by G. B. Payne and P. H. Williams in the Journal of Organic Chemistry, vol. 24, p. 54 (1959) which is incorporated herein by reference. For example, a combination of an oxidizer such as hydrogen peroxide and a catalyst such as sodium tungstate may be used. It is within the scope of the invention that not all of the ethylenically unsaturated double bonds present in the monomer(s) and comonomer(s) are epoxidized. Optionally, the neutralization step or partial neutralization may be carried out after forming the epoxides.

The epoxides are polymerized by means of an anionic polymerization process to form the polyether hydroxycarboxylate copolymer product. Any monomer(s) and/or comonomer(s) which have not been epoxidized may be polymerized such that either $X_1$ , $X_2$ , or both are equal to 0 in the polyether hydroxycarboxylate copolymer product. Preferably, $X_1$ and $X_2$ are equal to 1 in the polyether hydroxycarboxylate copolymer. The polymerization is conducted in the presence of calcium hydroxide or other alkaline calcium salts. A description of a method for polymerizing an epoxide derived from maleic acid is included in U.S. Pat. No. 4,654,159 which is incorporated herein by reference.

The polyether hydroxycarboxylate copolymer product containing sodium and calcium salts can be used in the form of an aqueous solution.

Alternatively, the sodium or calcium salts may be replaced by means of ion exchange by an alkali metal, such as sodium, or by ammonium, substituted ammonium, or hydrogen. Optional removal of low molecular weight components (n=1) may be carried out using a suitable process such as vacuum distillation.

In one embodiment of the invention, the process can be represented as follows:

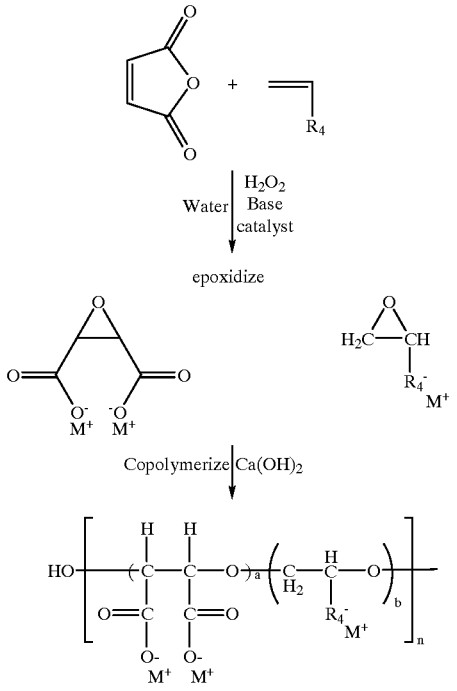

wherein $CH_2CHR_4$ is an ethylenically unsaturated comonomer containing carboxylic acid, phosphonic acid, sulfonic acid group or a combination thereof.

The concentration of the polyether hydroxycarboxylate copolymer in a textile manufacturing or treating process is preferably from about 0.001 to about 50 weight percent, based on the weight of the solution or dispersion used in the textile process. More preferably, the polyether hydroxycarboxylate copolymers are present in an amount of from about 0.1 to about 10 weight percent.

In one embodiment, where the polyether hydroxycarboxylate copolymer is used at the steps of desizing, scouring and bleaching textiles, not only a hydrogen peroxide-stabilized effect but also a high decomposition-promoting effect can be attained, and an abnormal decomposition by metal ions such as iron, copper and calcium ions can be controlled. Furthermore, a good dispersibility is given to decomposition products and a redeposition of decomposition products can be prevented. The polyether hydroxycarboxylate copolymers of the invention have the additional advantage of acting as complexing agents in softening water by complexing the "hardness" cations in water. The polyether hydroxycarboxylate copolymers form a soluble complex with calcium and magnesium ions which otherwise can react with soaps and other anionic surfactants and otherwise adversely affect detergency or cleaning of the textiles.

In one embodiment, where the polyether hydroxycarboxylate copolymer is used for the mercerization of cotton or flax, the polyether hydroxycarboxylate copolymer can be incorporated into a mercerizing bath or soaping bath of a yarn mercerizing machine or a knitted or woven fabric mercerizing machine. Since the alkali resistance of the polyether hydroxycarboxylate is good, a decomposition or separation of the polyether hydroxycarboxylate per se does not occur, the deposition of scales on a roll or the like is prevented, and the dispersibility of the bath is improved.

The polyether hydroxycarboxylate copolymer functions as a processing aid and complexes heavy metal ions in the manufacturing or treating of textiles. For example, the polyether hydroxycarboxylate copolymers help stabilize hydrogen peroxide in the bleaching process, reduce scale and prevent deposition of heavy metal ions such as iron, calcium and magnesium during the scouring, desizing, mercerising, and bleaching processes. In addition, the polyether hydroxycarboxylate copolymers prevent redeposition of particulate soils onto the textiles.

Furthermore, in the dyeing process, the polyether hydroxycarboxylate copolymers disperse direct and dispersed dyes, and suspend unfixed dyes, and thus, provide a consistent and level dyeing of textiles. An additional advantage is that the polyether hydroxycarboxylate copolymers complex salts, such as calcium, magnesium and iron salts, during the dyeing process which prevents the salts from depositing on the textiles and causing blemishes, or precipitating the dyes out of solution which reduces the efficiency of the dyes.

The following nonlimiting examples illustrate further aspects of the invention.

EXAMPLE 1

Preparation of a polyether hydroxycarboxylate copolymer containing 10 mole percent itaconic acid as a comonomer.

Maleic anhydride, 20 g (0.204 mole) and 3 g (0.023 mole) of itaconic acid were mixed with 32 g of deionized water. The maleic acid and itaconic acid were neutralized by dropwise addition of 29.3 (0.366 mole) of a 50% NaOH solution. The neutralization was carried out under cooling using an ice bath. The mixture was heated to 55° C. and 0.792 g (0.0024 mole) of sodium tungstate dihydrate dissolved in 3 g of deionized water was added. Hydrogen peroxide, 23.1 g (0.238 mole) of a 35% solution, was added to the mixture over a period of 30 to 60 minutes while maintaining a temperature of 55° C. to 65° C. The reaction mixture was heated at 60° C. for two hours. Sodium hydroxide, 7 g of a 50% solution, was added. The reaction temperature was maintained at 60° C. for two hours. Calcium hydroxide, 0.84 g (0.014 mole) was added, and the reaction temperature was increased to 95° C. to 100° C. for four hours to form a copolymer product. The polyether hydroxycarboxylate copolymer product was a clear amber colored solution.

EXAMPLE 2

Preparation of a polyether hydroxycarboxylate copolymer containing 10 mole percent vinyl phosphonic acid as a comonomer.

Maleic anhydride, 20 g (0.204 mole) and 3.12 g of a 80% solution (0.023 mole) of vinyl phosphonic acid (commercially available as ITC 467 from Albright and Wilson) were mixed with 32 g of deionized water. The maleic acid and vinyl phosphonic acid were neutralized by dropwise addition of 28.8 (0.36 mole) of a 50% NaOH solution. The neutralization was carried out under cooling using an ice bath. The mixture was heated to 55° C. and 0.792 g (0.0024 mole) of sodium tungstate dihydrate dissolved in 3 g of deionized water was added. Hydrogen peroxide, 23.1 g (0.238 mole) of a 35% solution, was added to the mixture over a period of 30 to 60 minutes while maintaining a temperature of 55° C. to 65° C. The reaction mixture was heated at 60° C. for two hours. Sodium hydroxide, 7 g of a 50% solution, was added with cooling. The reaction temperature was maintained at 60° C. for two hours. Calcium hydroxide, 0.84 g (0.014 mole) was added, and the reaction temperature was increased to 95° C. to 100° C. for five to six hours to form a copolymer product. The polyether hydroxycarboxylate copolymer product was a slightly opaque white solution.

EXAMPLE 3

Preparation of a polyether hydroxycarboxylate copolymer containing 7.5 mole percent itaconic acid as a comonomer.

Maleic anhydride, 20.6 g (0.2099 mole) and 2.2 g (0.017 mole) of itaconic acid were mixed with 33.5 g of deionized water. The mixture was heated to 60° C. to form a clear homogenous solution. Sodium tungstate dihydrate 1.089 g (0.0033 mol) dissolved in 4.0 g of Di water was then added. The reaction mixture turned yellow in color. Hydrogen peroxide, 27.6 g (0.284 mole) of a 35% solution, was added to the mixture over a period of 30 to 60 minutes while maintaining a temperature of 55° C. to 65° C. The reaction mixture turned a clear water white color and was heated at 60° C. for three to four hours. over 30 to 60 minutes while maintaining a temperature of 55 to 65° C. The reaction temperature was maintained at 60° C. for three to four hours. The reaction mixture was cooled down to room temperature. Sodium hydroxide, 2.3 g (0.045 mol)of a 50% solution, was added to complete the neutralization. Calcium hydroxide, 1.3 g (0.022 mole) was added, and the reaction temperature was increased to 95° C. to 100° C. for seven to eight hours to form a copolymer product. The polyether hydroxycarboxylate copolymer product was a clear light yellow solution.

EXAMPLE 4

Calcium Binding Properties

The calcium binding properties of the polyether hydroxycarboxylate copolymers prepared in Examples 1—3 were evaluated in a Hampshire Binding test. The Hampshire Binding test procedure was as follows:

(1) Prepare a 0.25M calcium acetate solution.

(2) Prepare a 2 weight percent copolymer solution based on solids of the copolymers prepared in Examples 1–3.

(3) Prepare a 2 weight percent sodium carbonate solution.

(4) Mix 50 grams of the copolymer solutions with 10 ml of the sodium carbonate solution. Dilute with deionized water up to 100 ml.

(5) Titrate the mixture prepared in Step 4 with the 0.25 M calcium acetate solution until the mixture remains cloudy.

TABLE I

| Polymer | Calcium binding mg $CaCO_3$/g polymer |
|---|---|
| Polyether carboxylate with 10.0 mole % itaconic acid of Example 1 | 208 |
| Polyether carboxylate with 10 mole % vinyl phosphonic acid of Example 2 | 206 |
| Polyether carboxylate with 7.5 mole % itaconic acid of Example 3 | 219 |

The test results in Table I show that the polyether carboxylate copolymers of the invention have good calcium binding properties.

EXAMPLE 5

Evaluation of Anti-redeposition Properties of Copolymers

The copolymers prepared in Examples 1, 2, and 3 were evaluated for antiredeposition properties. The anti-redeposition test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 0.9 g/L of a liquid detergent (composition listed below) and 150 ppm hardness water with a Ca to Mg ratio of 2:1. The soil used was 0.3 g/L rose clay, 0.16 g/L bandy black clay and 0.9 g/L of an oil blend (70% vegetable oil and 30% mineral oil). The polymers were dosed at 4 weight percent of the detergent weight. The rinse cycle was 3 minutes using 150 ppm hardness water with a Ca to Mg ratio of 2:1. A total of 3 cycles were carried out and the swatches were dried in a tumble dryer on medium setting. The L a b values before the first cycle and after the third cycle was measured as $L_1$, $a_1$, $b_1$, and $L_2$, $a_2$, $b_2$, respectively.

$$\Delta E=[(L_1-L_2)^2+(a_1-a_2)^2+(b_1-b_2)^2]^{0.5}$$

The UNBUILT liquid detergent contained 22.5 weight percent NEODOL 25-7, 18.8 weight percent BIOSOFT D40, 3 weight percent triethanol amine, 5 weight percent ethanol, 2 weight percent potassium chloride, and 48.8 weight percent water. NEODOL 25-7 is an alcohol ethoxylate containing $C_{12}$–$C_{15}$ alcohol with 7 moles of ethoxylation, available from Shell Chemical Co. BIOSOFT D40 is sodium dodecylbenzene sulfonate, available from Stepan Chemical Co. The test results are summarized in Table II.

TABLE II

| | Anti-Redeposition Test | | | |
|---|---|---|---|---|
| Copolymer | ΔE for cotton | Ave ΔE for cotton | Ave ΔE for polycotton | Ave ΔE for polycotton |
| Blank | 5.0 | | 3.6 | |
| | 5.1 | 5.2 | 3.3 | 3.4 |
| | 5.6 | | 3.4 | |
| Copolymer of Example 1 | 2.6 | | 2.2 | |
| | 2.7 | 2.8 | 2.4 | 2.4 |
| | 3.0 | | 2.5 | |
| Copolymer of Example 2 | 3.8 | | 2.8 | |
| | 3.1 | 3.4 | 3.0 | 2.8 |
| | 3.3 | | 2.7 | |
| Copolymer of Example 3 | 3.3 | | 3.3 | |
| | 3.0 | 3.2 | 2.8 | 2.9 |
| | 3.2 | | 2.6 | |

The test results in Table II clearly show that the polyether hydroxycarboxylate copolymers of the invention have significantly better anti-redeposition properties as compared to solutions without any polymer.

EXAMPLE 6

The polyether hydroxycarboxylate copolymers prepared in Examples 1, 2 and 3 were evaluated as bleach stabilizers in a series of tests conducted under typical textile bleaching conditions.

Bleaching solutions were prepared which contained 30 ml/l of 35% $H_2O_2$, 7 g/l of NaOH, 0.1 g/l of $MgSO_4$, $7H_2O$, 2 ppm of $Fe^{+2}$ (0.014 g of ferrous ammonium sulfate hexahydrate) and 12.5 g/l of either the polymer or copolymer. The bleaching treatment was carried out at 95° C. for 30 minutes. The residual amount of hydrogen peroxide was determined by an AATCC titration method. The test was repeated without the Mg and Fe ions to determine the level of active hydrogen peroxide. The percentage residual hydrogen peroxide based on total hydrogen peroxide was calculated. The test results are summarized in Table II.

TABLE II

| Bleach Stability Test | |
|---|---|
| Copolymer | % residual $H_2O_2$ based on total $H_2O_2$ for the Mg and Fe system |
| No polymer | 19.3 |
| Copolymer of Example 1 | 12.6 |
| Copolymer of Example 2 | 36.6 |
| Copolymer of Example 3 | 62.7 |

The test results in Table II show that the polyether hydroxycarboxylate copolymers prepared in Examples 2 and 3 are significantly better bleach stabilizers as compared to a solution without any polymer.

EXAMPLE 7

The polyether hydroxycarboxylate copolymers prepared in Examples 1–3 were evaluated in surfactant solutions.

The surfactant solution contained 22.5 weight percent NEODOL 25-7, 18.8 weight percent BIOSOFT D40, 3 weight percent triethanol amine, 5 weight percent ethanol, 2 weight percent potassium chloride, and 48.8 weight percent water. NEODOL 25-7 is an alcohol ethoxylate containing $C_{12}$–$C_{15}$ alcohol with 7 moles of ethoxylation, available from Shell Chemical Co. BIOSOFT D40 is sodium dodecylbenzene sulfonate, available from Stepan Chemical Co. The test results are summarized in Table III.

TABLE III

| Surfactant Compatibility Test | |
|---|---|
| Copolymer | Compatibility in surfactant solution using 3 wt % polymer |
| Copolymer of Example 1 | clear solution |
| Copolymer of Example 2 | almost clear solution |
| Copolymer of Example 3 | clear solution |

The test results in Table III show that the polyether hydroxycarboxylate itaconic acid derivative copolymer was more compatible than the polyether hydroxycarboxylate copolymer with NEODOL 91-8. In addition, Table III shows that the polyether hydroxycarboxylate itaconic acid derivative copolymer was more compatible than the polyether hydroxycarboxylate copolymer with a generic liquid detergent composition.

EXAMPLE 8

Evaluation of Copolymers in High Alkaline Solution

The polyether hydroxycarboxylate copolymer, 10 g/l, prepared in Example 1 by mixing each of the polymers with 10, 50, 100, and 200 g of NaOH (flakes) in 1 liter of water according to Table IV. The samples were allowed to stand for 24 hours. The stability and alkali resistance of each sample was evaluated based on the degree of the formation of precipitates and the presence or absence of surface separation. The test results are summarized in Table IV.

TABLE IV

| Alkali Resistance Test | | | | |
|---|---|---|---|---|
| | Amount (x) of NaOH | | | |
| Copolymer | 10 g/l | 50 g/l | 100 g/l | 200 g/l |
| Copolymer of Example 1 | 1 phase | 1 phase | 1 phase | 1 phase |

The results in Table IV show that at a 1% concentration level, the polyether hydroxycarboxylate copolymer was stable in 10 g/l, 50g/l, 100 g/l and 200g/l of caustic as represented by a clear homogeneous solution.

EXAMPLE 9

Evaluation of Copolymers as Iron Chelation in Alkaline Conditions

The copolymer prepared in Example 1 was evaluated for its ability to chelate calcium under alkaline conditions typically used in the textile industry.

The performance of the copolymer was compared to disodium ethylene diamine tetra acetate (VERSENE 100) which is a typical chelating agent.

Separate solution were prepared with 5 g of copolymer and EDTA in 500 g of deionized water. The solutions was stirred by means of a magnetic stir plate and the pH of the solution was adjusted to 12.0+–0.1 by addition of a 50% sodium hydroxide solution. 5 ml of 0.1M ferric chloride solution was added at room temperature (25 C.). The stirring was maintained for 5 minutes. The solutions were removed from the magnetic stir plate and observed after two minutes for presence of a brown precipitate of ferric hydroxide which will not dissolve. If a precipitate is present, the test is stopped. If a precipitate is not present, the solution is placed back on the stir plate and 5 ml of 0.1M ferric chloride solution is added and the pH adjusted to 12.0+–0.1 by addition of a 50% sodium hydroxide solution. The temperature and stirring are maintained for 5 minutes. The solution is removed from the stir plate and observed after two minutes for presence of brown precipitate. This procedure was repeated until the precipitate appeared.

The number of mls of 0.1M $FeCl_3$ required to form a precipitate is recorded. Subtract 5 ml from last titration to get mls. For example, if precipitate is first noticed after 40 ml $FeCl_3$, record the iron chelating capacity (FeCV) as 35 ml $FeCl_3$). If precipitate is present after $1^{st}$ 5 ml, the chelate has no iron chelation value per this test. The test results are summarized in Table VI.

TABLE VI

| Iron Chelating Test | |
|---|---|
| Copolymer/EDTA | Iron Chelating Capacity (ml of 0.1M $FeCl_3$ used in Titration) |
| Copolymer of Example 1 | >50 |
| EDTA (VERSENE 100) | 5 |

The test results in Table VI clearly show that the polyether hydroxycarboxylate copolymer of Example 2 effectively chelates iron in highly alkaline systems while EDTA was not effective as a processing aid under such alkaline conditions. While not wishing to be bound by any particular theory, the present inventors believe that the copolymers of the invention are effective chelating agents because they formed a stable chelate with ferric ions and delayed the formation of a brown precipitate of ferric hydroxide.

EXAMPLE 10

Preparation of a Polyether Hydroxycarboxylate Copolymer Containing 100 Mole percent acrylic acid as a comonomer Acrylic acid, 36.0 g (0.5 mole) was mixed with 25.0 g of deionized water. Sodium tungstate dihydrate 2.36 g (0.0071 mol) dissolved in 6.0 g of deionized water was then added. The reaction mixture turned in to an opaque white solution. Hydrogen peroxide, 60.7 g (0.625 mole) of a 35% solution, was added to the mixture over a period of 1 to 2 hours while maintaining the reaction at a temperature of 20° C. to 30° C. The reaction mixture turned a clear light yellow color and was heated at 60° C. for five hours. The reaction mixture was cooled down to room temperature. Sodium hydroxide, 30.0 g (0.375)of a 50% solution, was added to over 30 to 60 minutes to partially neutralize the acrylic acid to 75 mole percent. The reaction mixture was then heated at 60° C. for 8 to 10 hours. The reaction was then cooled to room temperature and 6.5 g of a 50% solution of sodium hydroxide (0.08125 mole) was added. Calcium hydroxide, 3.08 (0.0416 mole) was added, and the reaction temperature was increased to 95° C. to 100° C. for seven to eight hours to form a copolymer product. The polyether hydroxycarboxylate copolymer product was a opaque white solution which was neutralized with 3.0 g of citric acid (0.0156 mole) to lower the pH to 10.

While the invention has been described with particular reference to certain embodiments thereof, it will be understood that changes and modifications may be made by those of ordinary skill in the art within the scope and spirit of the following claims.

What is claimed is:

1. A processing aid for use in a textile manufacturing or treating process, said processing aid comprises a polyether hydroxycarboxylate polymer or copolymer having the structure

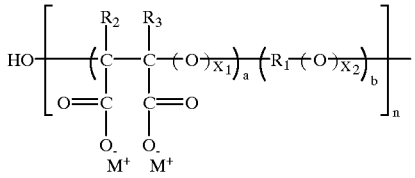

wherein $M^+$ is a cation having a +1 charge, or $M^+$ and $M^+$ together are a single cation having a +2 charge wherein M is independently selected from the group consisting of hydrogen, ammonia, alkali metals, alkaline earth metals, zinc, copper, organic amines, amino acids, and amino saccharides; $R_1$ is the residue of an ethylenically unsaturated comonomer having at least one functional group which is selected from the group consisting of carboxylic acid, sulfonic acid and phosphonic acid; $R_2$ and $R_3$ are independently selected from the group consisting of hydrogen, and a substituted or unsubstituted alkyl group having 1 to 4 carbon atoms; n is from about 2 to about 100; $x_1$ and $x_2$ are independently 0 or 1, with the proviso that the sum of $x_1$ and $x_2$ is at least 1; a is from 0 to 100 mole percent; and b is from 100 to 0 mole percent, provided that (a+b) is 100 mole percent, wherein said processing aid is present in an amount of from about 0.001 to about 50 weight percent, based on the weight of the solution or dispersion used in the textile process.

2. A processing aid for use in a textile manufacturing or treating process, said processing aid comprises a polyether hydroxycarboxylate polymer or copolymer having the structure

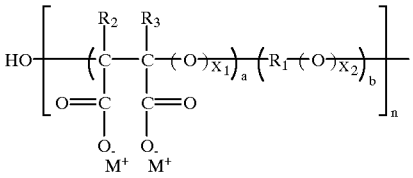

wherein $M^+$ is a cation having a +1 charge, or $M^+$ and $M^+$ together are a single cation having a +2 charge, wherein M is independently selected from the group consisting of hydrogen, ammonia, alkali metals, alkaline earth metals, zinc, copper, organic amines, amino acids, and amino saccharides; $R_1$ is the residue of an ethylenically unsaturated comonomer having at least one functional group which is selected from the group consisting of carboxylic acid, sulfonic acid and phosphonic acid; $R_2$ and $R_3$ are independently selected from the group consisting of hydrogen, and a substituted or unsubstituted alkyl group having 1 to 4 carbon atoms; n is from about 2 to about 100; $x_1$ and $x_2$ are independently 0 or 1, with the proviso that the sum of $x_1$ and $x_2$ is at least 1; a is from 0 to 100 mole percent; and b is from 100 to 0 mole percent, provided that (a+b) is 100 mole percent, wherein said processing aid is present in an amount of from about 0.1 to about 10 weight percent, based on the weight of the solution or dispersion used in the textile process.

3. The processing aid according to claim 1 wherein the polyether hydroxycarboxylate copolymer is prepared from maleic acid and itaconic acid.

4. The processing aid according to claim 1 wherein the polyether hydroxycarboxylate copolymer is prepared from maleic acid and vinyl phosphonic acid.

5. The processing aid according to claim 1 wherein the polyether hydroxycarboxylate copolymer is prepared from maleic acid and malonic acid.

6. The processing aid according to claim 1 wherein n is from about 2 to about 20.

7. The processing aid according to claim 1 wherein in the polyether hydroxycarboxylate copolymer the letter a is from 20 to 99 mole percent, and the letter b is from 1 to 80 mole percent, provided that (a+b) is 100 mole percent.

8. The processing aid according to claim 1 wherein M is an alkali metal.

9. The processing aid according to claim 1 wherein R2 and R3 are hydrogen.

10. The processing aid according to claim 1 which is used in a textile scouring process.

11. The processing aid according to claim 1 which is used in a textile desizing process.

12. The processing aid according to claim 1 which is used in a textile dyeing process.

13. The processing aid according to claim 1 which is used in a textile mercerising process.

14. The processing aid according to claim 1 which is used in a textile bleaching process.

15. The processing aid according to claim 14 wherein the bleaching process comprising from about 0.1% to about 35% by weight, based on the weight of the bleaching bath, of inorganic or organic peroxy bleaching agent.

16. A textile material treated with the composition according to claim 1.

17. In a aqueous scouring composition, the improvement comprising adding from about 0.001 to about 50 weight percent, based on the total weight of the scouring composition, of a polyether hydroxycarboxylate polymer or copolymer having the structure

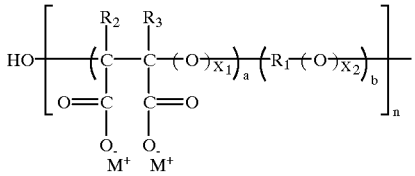

wherein $M^+$ is a cation having a +1 charge, or $M^+$ and $M^+$ together are a single cation having a +2 charge, wherein M is independently selected from the group consisting of hydrogen, ammonia, alkali metals, alkaline earth metals, zinc, copper, organic amines, amino acids, and amino saccharides; $R_1$ is the residue of an ethylenically unsaturated comonomer having at least one functional group which is selected from the group consisting of carboxylic acid, sulfonic acid and phosphonic acid; $R_2$ and $R_3$ are independently selected from the group consisting of hydrogen, and a substituted or unsubstituted alkyl group having 1 to 4 carbon atoms; n is from about 2 to about 100; $x_1$ and $x_2$ are independently 0 or 1. with the proviso that the sum of $x_1$ and $x_2$ is at least 1; a is from 0 to 100 mole percent; and b is from 100 to 0 mole percent, provided that (a+b) is 100 mole percent.

18. The aqueous scouring composition according to claim 17 wherein the polyether hydroxycarboxylate copolymer is present in an amount of from about 0.1 to about 10 weight percent, based on the weight of the aqueous scouring composition.

* * * * *